United States Patent [19]

Headley

[11] Patent Number: 5,064,108

[45] Date of Patent: Nov. 12, 1991

[54] LOAD-BEARING BELT

[76] Inventor: Robert W. Headley, 11020 Walpole Rd., Crooksville, Ohio 43731

[21] Appl. No.: 506,627

[22] Filed: Apr. 9, 1990

Related U.S. Application Data

[63] Continuation-in-part of Ser. No. 292,016, Dec. 30, 1988, Pat. No. 4,916,594.

[51] Int. Cl.[5] ..... A45F 5/00

[52] U.S. Cl. ..... 224/253; 224/259; 224/902

[58] Field of Search ..... 224/204, 206, 208, 211, 224/215, 216, 224, 253, 259, 260, 262, 902, 904, 214; 455/100; 362/108

[56] References Cited

U.S. PATENT DOCUMENTS

| | | | |
|---|---|---|---|
| 1,198,202 | 9/1916 | Drinkard | 224/211 X |
| 1,723,147 | 8/1929 | Fourethier | 224/902 X |
| 1,871,223 | 8/1932 | Reese | 224/208 X |
| 2,149,803 | 3/1939 | Wight | 224/259 |
| 2,190,601 | 2/1940 | LaVan | 224/902 X |
| 2,625,192 | 1/1953 | Kinskie | 224/902 X |
| 4,114,788 | 9/1978 | Zufich | 224/211 X |
| 4,412,106 | 10/1983 | Pavel | 224/253 X |
| 4,608,716 | 9/1986 | Brumfield | 2/2.5 |
| 4,923,105 | 5/1990 | Snyder | 224/216 X |
| 4,941,604 | 7/1990 | Nagareda | 224/253 X |

FOREIGN PATENT DOCUMENTS

| | | | |
|---|---|---|---|
| 7797 | 3/1911 | United Kingdom | 224/216 |

*Primary Examiner*—Henry J. Recla
*Assistant Examiner*—Robert M. Fetsuga
*Attorney, Agent, or Firm*—Watkins, Dunbar & Pollick

[57] ABSTRACT

A specially designed, two section, adjustable belt using an adjustable connection between the sections at the back of the user is described. The adjustable connection allows the weight of a load to be positioned over the hips of a user thereby reducing back strain and discomfort. An adjustable weight-distributing shoulder harness is described with back-crossing straps that are movably secured to each other where they cross by a strap secured to one of the shoulder straps to define an opening that movably receives the other shoulder strap. A load strap is used to secure the load to the belt and uses a position ring for centering the load on the load strap.

11 Claims, 4 Drawing Sheets

LOAD-BEARING BELT

This Patent Application is a Continuation-In-Part of U.S. application Ser. No. 07/292,016 filed Dec. 30, 1988 by the same inventor as this application and issued on Apr. 10, 1990 as U.S. Pat. No. 4,916,594.

FIELD OF THE INVENTION

This invention relates generally to a circuit-protected portable power supply and in particular to a circuit-breaker protected power supply that is supported on a belt and harness worn by a user.

BACKGROUND OF THE INVENTION

The prior art, as exemplified by U.S. Pat. Nos. 1,723,147 to Fourethier, Aug. 6, 1929; 2,275,765 to Hummert et al. Mar. 10, 1942; 2,724,769 to D,Arbeloff, Nov. 22, 1955; 4,231,079 to Heminover, Oct. 28, 1980; and 4,328,533 to Paredes, May 4, 1982 is generally illustrative of the pertinent art. None of the devices shown in the prior art protects the circuitry and appliances from burn out as a result of short circuits and other circuitry failure. Such burnout can be extremely costly when the power pack, connecting cables, and appliances are sophisticated or of a heavy duty nature. Although some effort has been made in the past to use fuses in such circuitry, this has proven to be unsatisfactory in unsafe circumstances where the user may not have the time or be able to change such a fuse. For example, it is especially inconvenient to attempt to change a fuse in total darkness such as might be encountered in mining operations or night sporting activities such as racoon hunting.

Another disadvantage with the prior art is that the power pack is often worn about the waist and suspended at the center of the back. Such positioning can be especially troublesome to persons with lower back problems. Moreover, it is almost impossible to wear such a back centered power pack in an automobile or truck.

SUMMARY OF THE INVENTION

The present invention solves these problems by providing a power pack with circuit-breaker protection enabling the user to quickly reset the circuit rather than having to fumble about in the darkness trying to remove a blown fuse and then trying to find and install a new fuse, if indeed the user is so fortunate to carry a fresh fuse. One or more additional circuits can be provided to allow for the simultaneous use of two or more devices or for use as a backup circuit should the first circuit fail. Thus the user could use a second circuit backup light to change a bulb or otherwise repair the first circuit. Or failing to repair the first circuit, the backup light could be used to enable a miner or hunter to return to safety.

In addition, this invention provides a belt which is adjustable at the back so as to distribute the weight of the power packs to the sides and over the hips of the user thereby alleviating the aggravation of back problems that are present with the conventional suspension of the power pack weight at the center of the back and also enabling the user to wear such a power pack in a truck or car.

The circuit-protected power supply of this invention consists of a power pack, that is, one or more batteries or some other power source, wiring or other electrical connections to form a circuit connected to the power pack, a circuit breaker that forms a part of the circuit and is designed to protect the circuit, and a means for a user to carry or support the power pack on his or her person. The power pack and circuitry is connected to an electrical device such as an appliance as typified by a video tape recorder camera or a lamp such as a spot or flood light or a charging device for the power pack batteries. The circuitry may be provided with a device for conveniently connecting and disconnecting the appliance from the power pack circuit. Such connecting means may be a plug and jack. The power pack may contain additional circuits for connecting additional appliances to the power pack. For example, one of the circuits can be to a light which is worn on a hat as is typified by a miner's hat while the second circuit is connected to a hand-held spotlight. By using two circuits, one of the circuits can be provided with one or more resistors in series and a means for selecting the resistance to be placed in the circuit. Such a selection means can be a rotary switch. Such an arrangement allows a person to use one of the devices at full power while selecting varying amounts of resistance to restrict the amount of power available to the second device.

The power pack batteries are secured about the waist of a user by means of a belt to which the batteries are attached by means of a power pack housing. The circuit breaker, switch, resistors, jacks and other components are contained in a circuit breaker housing that is also fastened to the belt. The belt can be divided at the rear into two sections so that a means for varying the space between the sections at the back of the user can be provided. Such a space varying means can be one or more straps attached to the two sections of the belt and a means for adjusting the distance between the two sections of the belt. Such an adjusting means can be a belt buckle. By using a belt with a space adjusting means at the back, the weight of the power packs can be distributed to the sides and over the hips of the wearer thereby tending to alleviate aggravation to the lower back. Also in the position, the power pack can be comfortably worn while seated in a car, something which can not be done when the power pack is positioned on the back of the user.

The weight of the power pack can be further distributed on the shoulders of the wearer by attaching shoulder straps to the front and rear of the belt. The shoulder straps can be crossed at the back and secured to each other at the point where they cross. In addition, the straps can be provided with a means for adjusting their length. Typically, such an adjustment means is a ring attached to the belt whereby the strap passes through the ring and is secured back onto itself by means of a buckle.

In addition to a power pack, this invention can also be used for other loads. For example, the load could be tools, gas cylinders, and other objects where it is desirable to distribute the weight of the object evenly on the wearer and thereby eliminate fatigue and undue stress on the back. In instances where the user is involved in an activity which requires considerable upper arm and shoulder movement, it is desirable that the suspension shoulder strap not be rigidly secured to each other but rather that they move relative to where they cross on the back of the user. It is also desirable that the point of crossing should also be adjustable so as to enable use by shorter and taller users.

In order to accomplish both the moveability and adjustment features of the straps, it is desirable to have two or more structures on the first shoulder strap that receive and cooperate with the second shoulder strap so that the second shoulder strap is movably secured to the first shoulder strap where they cross on the back of the user. The method of accomplishing interaction between the two straps is to attach a short strap to the first shoulder strap. Attachment is made at both ends of the short strap and in at least one point between the end attachment points so that at least two openings are formed between the first shoulder strap and the short strap. The second shoulder strap is movably inserted through these openings. The openings should be of sufficient length to allow for lateral movement of the second shoulder strap within the opening.

A short strap can also be attached to the second shoulder strap forming a plurality of openings on the second strap so that the first strap can be movably received through the openings formed between the second shoulder strap and the short strap attached to it. By using a plurality of openings on both straps, maximum flexibility is achieved, especially between left and right handed users, who wish to adjust one shoulder strap rather than the other.

It is also desirable to have a means for quickly attaching loads to the belt and a means to maintain the load in a relative non-moving position relative to the belt. The means for achieving such a load securing means is a load strap that is fastened at its first end to a section of the belt and at its second end to the other end of the same section of the belt. The first end is permanently attached while the second end of the load securing strap is attached to the belt section with a means for fastening and unfastening the load strap. Typically such a means for fastening and unfastening the load strap is a buckle fastened to the belt section and holes in the load strap for interacting with a tang on the buckle. Typically the load strap secures the load by passing through loops on the load. Typically, such loops can be made on the load by making parallel slits in the load material that form a loop through which the load strap can pass. Other loop-type devices can also be attached to the load, for example, loops that are affixed to the load and that allow the load strap to pass between the loop and the load.

In order to prevent movement of the load along the load strap, it is desirable to use a means for stabilizing or otherwise retarding the movement of such load on the load strap. Such means can be a position ring that is mounted on the belt section approximately midway between the attachment of the first and second ends of the load strap. The load strap is then threaded through a loop on the load, then through the position ring, and then through a second loop on the load, and finally attached to the belt. By using such an arrangement, the load is restrained from lateral movement on the load strap.

Other objects and features of the invention will be apparent and understood from the detailed description of the invention and the accompanying drawings which follow. The foregoing and other advantages of the invention will become apparent from the following disclosure in which a preferred embodiment of the invention is described in detail and illustrated in the accompanying drawings. It is contemplated that variations in procedures, structural features and arrangement of parts may appear to the person skilled in the art without departing from the scope or sacrificing any of the advantages of the invention.

BRIEF DESCRIPTION OF THE DRAWINGS

In the accompanying drawings, in which is shown one of the various possible illustrative embodiments of this invention, like reference characters identify the same or like parts.

DETAILED DESCRIPTION OF THE INVENTION AND BEST MODE FOR CARRYING OUT THE PREFERRED EMBODIMENT

Figure 1:
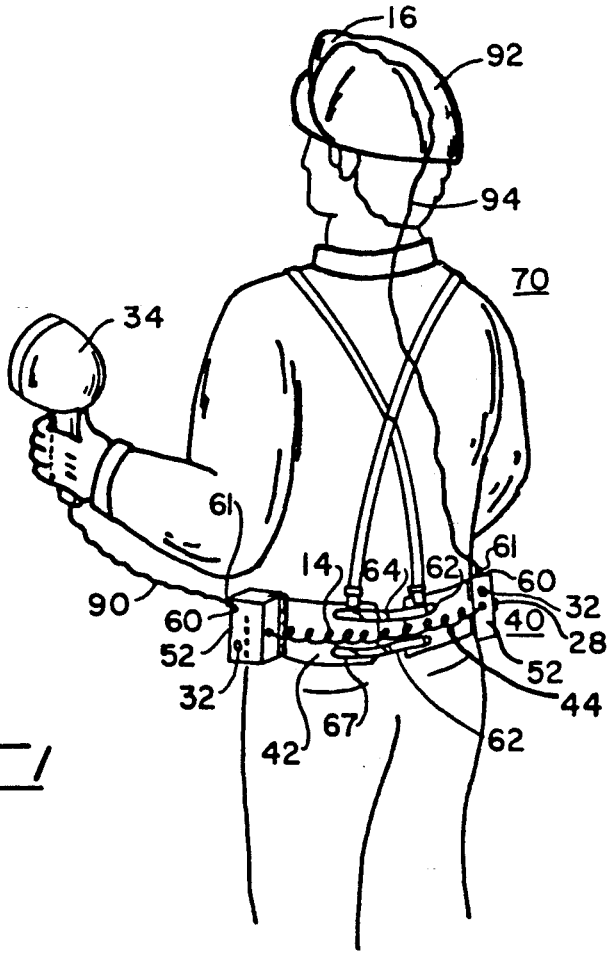
FIG. 1 is a view in perspective showing a person wearing the power pack of this invention and showing the power pack connected to a hand-held light and a hat mounted light.
Figure 3:
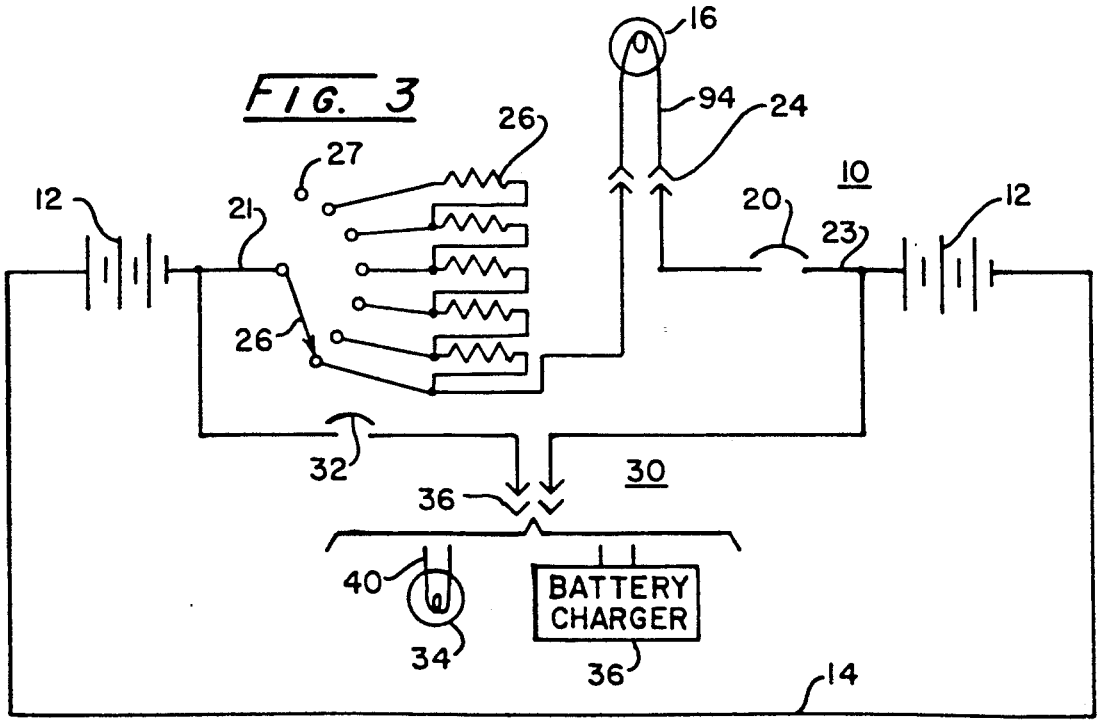
FIG. 3 is a schematic diagram of the electrical circuits of this invention.
Figure 2:
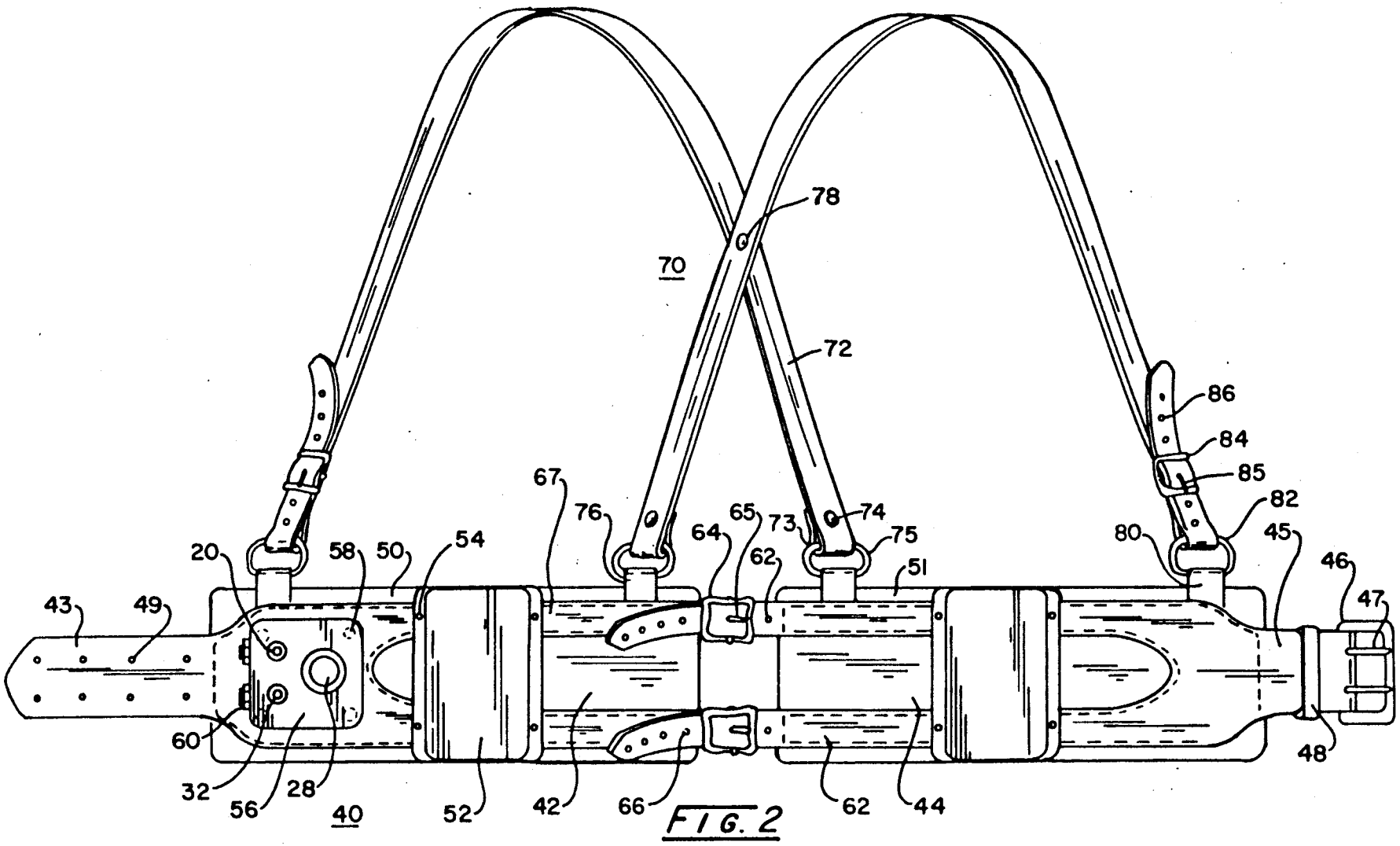
FIG. 2 is a view in perspective of the shoulder harness and belt with the power pack and control device attached.

In reference to the drawings there is shown and illustrated in FIGS. 1-3 an electrical assembly designated generally by reference character 10, a belt assembly designated generally by reference character 40, and a shoulder harness assembly designated generally by a reference character 70. As shown in FIG. 3, the electrical assembly 10 consists of two or more batteries 12 connected in series by electrical connector 14 that preferably is coiled to allow for adjustment in length (FIG. 1). Preferably each battery 12 is a six-volt battery which, when combined in series, gives a 12 volt system. The battery typically is a Model 4-6 Gel Cell manufactured by Yuhasa of Santa Fe Springs, Calif. or a comparable equivalent. Although it is possible to use the present invention with only one battery, two batteries are used to provide an even distribution of weight on the user's body. Other combinations of battery voltages and number of batteries may be used depending on the application for which the power pack is to be used.

To complete the circuit, an electrical device such as a lamp 16 or other electrical appliance and circuitbreaker 20 are connected to the batteries 12 by connectors 21, 94 and 23. Means is provided for connecting and disconnecting the lamp 16 or other electrical device from the circuit by means of a connector 24 that consists of a plug 61 and jack 60 or other equivalent connecting device. A suitable plug is the model 3502 plug made by the Switchcraft of Chicago, Ill. The jack is a model 3501FP or FR jack also made by Switchcraft. The lamp 16 is a model 5100 or 5200 made by the Wheatlight Co. of Marlborough, Mass. or a model NHL 83 made by the Nite Lite Co., Clarksville Ak. The circuit breakers are 3 or 5 amp breakers, models W28XQIA-3 or W28XQIA-5, respectively, made by the Potter Broomfield, Co. (Siemens) Franklin, Ky. The intensity of the lamp 16 can be varied by a set of resistors 26 placed in series. For the present application, 2 or 5 ohm, five watt wire wound resistors made by Phillips ECG, Inc. of Williamsport, Pa. are used to give a total resistance of about 10 to 15 ohms. The amount of resistance placed into the circuit is selected by the switch 26 which is a model MRX-108 made by NKK of America, Inc. of Scottsdale, Ariz. The switch 26 may also have an on-off position 27. A second circuit 30 can be connected to the batteries 12 and consists of a circuit-breaker 32 and an electrical device such a lamp 34 or a battery charger 36. The second lamp can be a 12 V halogen or sealed beam hand spotlight such as a model H1285 made by the Nite Lite Co. A typical battery charger 36 to be used with this device is a ZX Power Supply made by Sinclair Company of the United Kingdom. The battery charger 36 can be of a type such as to plug into the cigarette lighter of a truck or car for on the road charging or it can be of a type for connection to a 110-volt outlet for charging when alternating current is available or both. A connector 37 similar to connector 24 can be used to connect and disconnect the electrical device from the circuit.

A wide variety of electrical components are known in the art that can be substituted for the above mentioned components. The above components are given to exemplify a preferred embodiment rather than in any way to limit this invention.

Shown in FIG. 2, the belt portion of this invention consists of two sections 42 and 44. Belt section 42 has a tongue section 43 joined to it and belt section 44 has a buckle section 45 joined to it, the tongue section 43 and buckle section being joined together in the front of the user. The illustrated fastening device consists of a buckle 46 which has a double tongue 47 which is fitted interchangeably through openings 49 in the tongue section 43 of belt section 44. Holes 49 allow the belt to be adapted and tightened about the body of the wearer. The loop 48 at the end of the buckle section 45 of belt section 44 holds the tongue section 43 of belt section 42 in place when the belt is fastened. Many other belt fastening devices are known including Velcro-type fasteners, all of which are considered to be suitable fastening means for this invention.

The batteries 12 are attached to the belt sections 42 and 44 by means of a battery cover or casing 52. When the battery 12 is of a rechargeable type, the battery is placed inside the battery casing 52 and securely attached to the belt by means of a suitable fastening device such as rivets 54. A control box 56 is also suitably attached to the belt section 42 by suitable fastening means such as rivets 58. The control box 56 houses the resistors 26, the resistor selection switch 28, connecting jacks 60 and circuit breakers 20 and 32. As shown in FIG. 1, the control box 56 can be preferably eliminated by placing the connecting jacks 60, resistors 26, circuit breakers 32, and resistor selection switch 28 in battery casing 52.

Sections 42 and 44 of the belt are joined at the back by means of straps 62 which are affixed to belt section 44 and buckle straps 67 and buckles 64 which are affixed to belt section 42. The tongue 65 of the buckle 64 is fitted interchangeably through the openings 66 of strap 62. By using the strap 62 and buckle 64 to adjust the distance between belt sections 42 and 44, the position of the battery 12 which is found inside of battery cover 52 can be shifted so as to distribute the weight of the battery on the user's hips thereby providing additional support for the battery pack and alleviating undue strain upon the back of the user. As illustrated in FIG. 2, the belt section 44 is formed from a piece of material that is distinct from the buckle end 45 and straps 62 which are formed from another piece of material and stitched to belt section 44. Similar considerations also apply to the buckles 64, the buckle straps 67, the tongue section 43, and belt section 42. Such a combination is preferable for the comfort, strength, and durability it provides. Many other combinations including a single piece construction are possible and considered to be equivalent for the purpose of this invention. For example, in FIG. 1, buckle straps 67 and straps 62 are joined to sections 42 and 44 respectively and are not integral with tongue section 43 and buckle section 45.

To further distribute the weight of the batteries on the person of the user, shoulder harness 70 is used. The shoulder harness 70 consists of two straps 72. A closed loop 73 is formed in one end of the strap 72 by means of a suitable fastening means such as a rivet 74. The closed loops 73 secure rings 75 which are secured to belt sections 42 and 44 by means of loops 76. The straps 72 cross on the back of the user and are held securely in place at the point of intersection by means of a rivet 78 or other suitable fastening means. Rings 82 are securely fastened to the front portion of belt sections 42 and 44 by means of loops 80. The straps 72 are adjustably fastened through rings 82 by means of a buckle 84 that is secured to strap 72 and embodying a tongue 85 which is fitted interchangeably through openings 86 in the end of strap 72. Of course there are many ways by which straps 72 can be secured to belt section 40. The means illustrated is that preferred by the inventor and in no way is meant to be a limiting feature of this invention.

Figure 4:
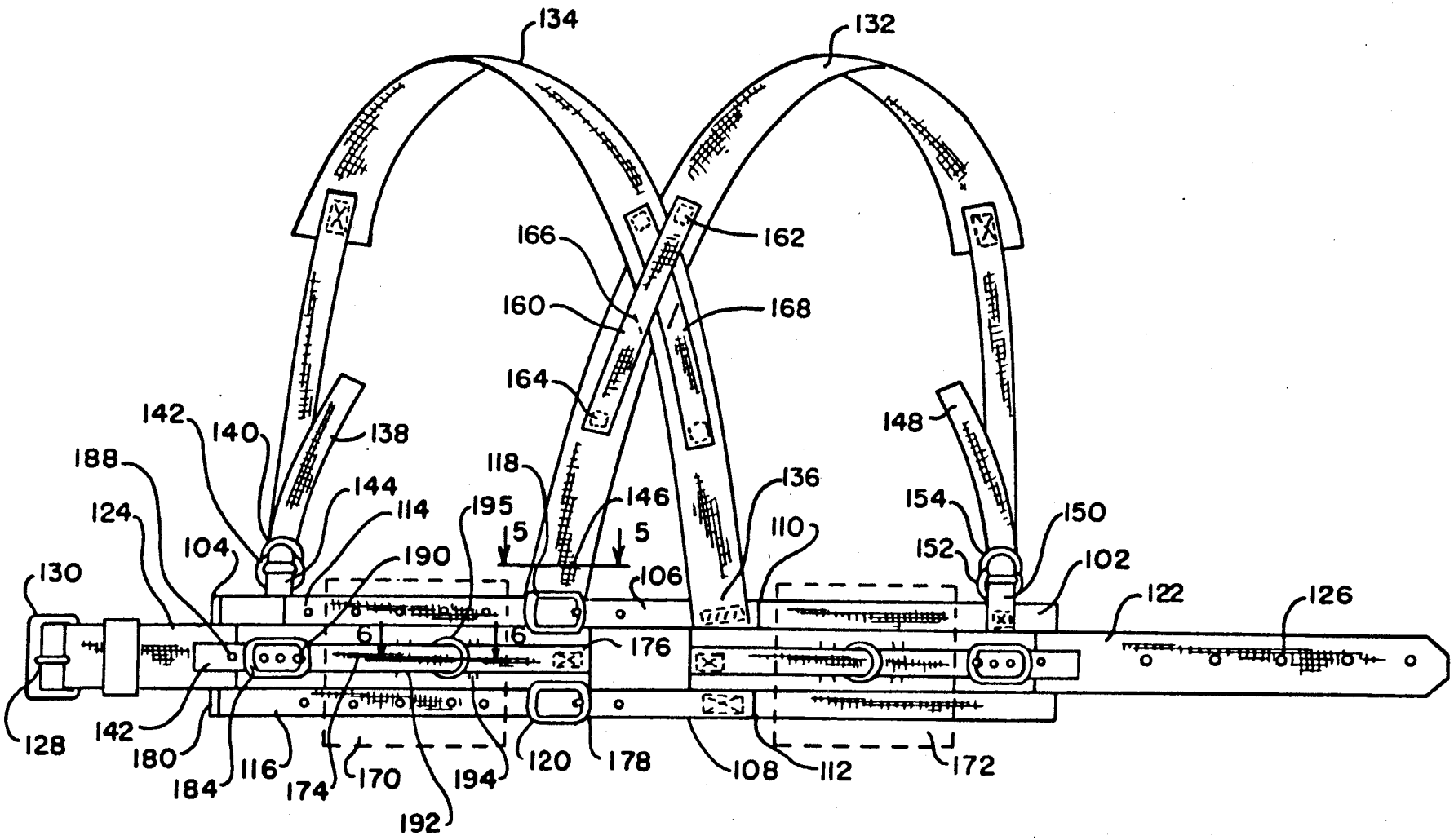
FIG. 4 is a back elevational view of an alternate embodiment of the invention.
Figure 6:
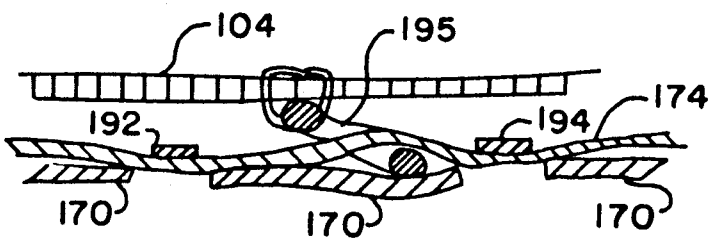
FIG. 6 is a partial cross section through 6—6 of FIG. 4.
Figure 5:
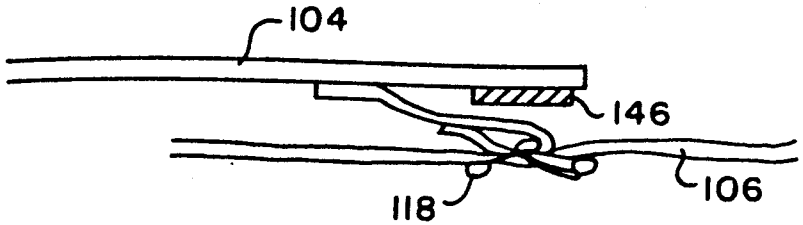
FIG. 5 is a partial cross section through 5—5 of FIG. 4.

FIG. 1 illustrates the invention as it might be worn by a typical user. The batteries inside of battery covers 52 are joined by coiled connector 14 and are positioned on the hips of the user by means of the adjustable strap 62, buckle 64 and buckle strap 67. The lamp 34 is connected to the batteries by means of connector cable 90, plug 61, and jack 60. Lamp 16 is secured to the front of hat 92 and connected to the power pack secured in housing 52 by means of connector cable 94, plug 61 and jack 60. Shoulder harness 70 further supports and distributes the weight of the batteries on the person of the user. In the alternate version of the invention shown in FIG. 4, first belt section 104 is joined to second belt section 102 at the back of the user by means of straps 106 and 108. A first end 110 of strap 106 and a first end 112 of strap 108 are securely fastened to a first end 178 of second belt section 102, as, for example, by sewing. Buckles 118 and 120 are securely attached to a first end of first belt section 104. The second end 114 of strap 106 and the second end 116 of strap 108 are secured to the first belt section 104 by means of buckles 118 and 120.

A belt tongue section 122 is securely fastened to second belt section 102. A buckle section 124 is securely fastened to first belt section 104. Belt section 122 is joined with buckle section 124 by means of eyes 126 in belt section 122 that engage the tang 128 of buckle 130 that is attached to the end of buckle section 124.

A first end 136 of shoulder harness 134 is attached to the first end of belt section 102. The second end 138 of shoulder strap 134 is attached to the second end of belt section 104 by means of suitable fastening means such as the two rings 140 and 142 that are attached to the second end of the belt section 104 by means of a loop 144. Shoulder strap end 138 is secured to the second end of belt section 104 by passing it through the center of rings 140 and 142, passing it over ring 142, and back through ring 140. The first end 146 of shoulder strap 132 is securely fastened to the first end of belt section 104. The second end 148 of shoulder strap 132 is secured to the second end of belt section 102 by means of two rings 152 and 154 attached to belt section 102 by means of loop 150.

To allow for flexibility and movement of shoulder straps 132 and 134, it is desirable that they be not rigidly affixed to one another at the back of the user at the point of crossing. To provide for movement of straps 132 and 134 relative to one another, they are movably secured to each other. Such securement is established by means of a short strap 160 that is rigidly attached to shoulder strap 132 at its ends 162 and 164. By also affixing the short strap 160 to the shoulder strap 132 at a point approximately half-way between the ends of short strap 160, that is ends 162 and 164, loops are formed through which shoulder strap 134 can movably pass. By choosing between the upper or lower loop, the straps can be adjusted to fit taller or shorter users.

Each of the loops formed by the shoulder strap 160 and the shoulder strap 132 is of such length as to permit lateral movement by strap 134 so as to accommodate arm and shoulder movement of strap 132.

A similar type arrangement may also be used on strap 134 using shorter strap 168 that is attached to strap 134 in a fashion similar to that of the attachment of short strap 160 to shoulder strap 132. By providing short straps on both of the shoulder straps 132 and 134, the harness can be easily adapted to left and right hand users.

The load 170 (as shown in phantom in FIG. 4) is attached to the first belt section 104 by means of a flexible load strap 174. Load strap 174 is attached at a first end 176 to the first end 178 of the first belt section 104 as, for example, by sewing. The second end 182 of the load strap 174 is attached to the second end 180 of the belt section 104 by means of buckle 184 that is rigidly secured to the second end 180 of the belt section 104. The second end 182 of the load strap 174 is secured to the buckle 184 by means of eyes 188 and buckle tang 190. Loops 192 and 194, a part of or attached to the load 170, are used to secure the load to the belt section 104. This is accomplished by passing the end of the load strap 182 through the loops at 194 and 192 and then attaching the end of the load strap 182 to the buckle 184.

To center the load 170 on the load strap 174 and reduce its lateral motion on the load strap, a ring 195 is securely attached to belt section 104 approximately midway between the attachment of the buckle 184 and the end 176 of load strap 174 to belt section 104. Load 170 is secured to the belt section 104 by means of load strap 174. The end 182 of load strap 174 is first passed through a loop 194 on the load and then through the load ring 195 and then through a second loop 192 on the load and then secured to the other end of belt section 104 by means of buckle 184.

Load 172 is attached to the second belt section 102 in a manner similar to the attachment of 170 to belt section 104. It should be noted that it is desirable to divide the weight of the load 170 and 172 about equally among the first belt section 104 and the second belt section 102 in order to maximize the elimination of back strain on the user. For safety considerations, all or portions of this invention can be made of reflective material.

It is possible that changes in the configurations to other than those shown could be used without departing from the spirit and scope of this invention. That which is used is preferred and typical.

Without departing from the spirit of this invention, various means of fastening the various components together may be used. It is therefore understood that although the present invention has been specifically disclosed with the preferred embodiment and examples, modifications to the design concerning sizing and shape may be apparent to those skilled in the art, and such modifications and variations are considered to the within the scope of the invention and the appended claims.

I claim:

1. A weight-distributing harness comprising:
   a. a load;
   b. a belt for securing said load and distributing said load on a user comprising:
      1) a first belt section and a second belt section,
      2) a means for securing said sections around said user,
      3) a means for varying the space between said first and said second sections at the back of said user comprising one or more straps attached to said first belt section and means for adjustably fastening said strap or straps to said second belt section;
      4) a means for securing said load to said belt; and
      5) two suspension shoulder straps with a first shoulder strap attached to the front of said first belt section and to the rear of said second belt section and a second shoulder strap attached to the front of said second belt section and to the rear of said first belt section.

2. The weight-distributing harness according to claim 1 wherein said suspension shoulder straps cross each other at the back of said user.

3. The weight-distributing harness according to claim 2 wherein said suspension shoulder straps are movably secured to each other where they cross each other on the back of said user so as to allow for lateral movement of said first shoulder strap with respect to said second shoulder strap.

4. The weight-distributing harness according to claim 3 wherein said first shoulder strap has a plurality of means for receiving and cooperating with said second strap so as to movably secure said second strap to said first strap where they cross on said back of said user.

5. The weight-distributing harness according to claim 4 wherein said plurality of means for receiving and cooperating with said second strap is formed from a short strap attached at each of its ends and in at least one point between said end attachments to said first shoulder strap so as to form a plurality of openings between said first shoulder strap and said short strap for movably receiving said second shoulder strap.

6. The weight-distributing harness according to claim 1 with means for adjusting the length of said shoulder straps.

7. The weight-distributing harness according to claim 1 with said means for securing said load to said belt comprising:
   a. a flexible load strap having a first and second end;
   b. said first end of said load strap permanently attached to a first end of said first belt section;
   c. means for releasably attaching said second end of said load strap to a second end of said first belt section; and
   d. means for centering said load on said load strap comprising a position ring attached to said first belt section at a point approximately midway between said attachment of said first end and said second end of said load strap to said first belt section, said ring receiving said load strap when said load is secured to said belt.

8. The weight-distributing harness according to claim 7 wherein said means for attaching said load strap to said second end of said first belt section is a buckle attached to said second end of said first belt section and having a tang for cooperating with securing holes in said second end of said load strap.

9. The weight-distributing harness according to claim 1 with said belt at least partially comprising reflective material.

10. A harness for securing a load comprising:

a. a belt for securing said load and distributing said load on a user comprising:

1) a belt;

2) a means for securing said belt around said user, 3) a means for securing said load to said belt comprising:

a. a load strap having a first and second end;

b. said first end of said load strap permanently attached to said belt;

c. means for releasably attaching said second end of said load strap to said belt; and d. means for centering said load on said load strap comprising a position ring attached to said belt at a point approximately midway between said attachment of said first end and said second end of said load strap to said belt, said ring receiving said load strap when said load is secured to said belt.

11. The harness for securing a load of claim 10 further comprising two suspension shoulder straps with a first shoulder strap attached to the front of said belt and to the rear of said belt and a second shoulder strap attached to the front of said belt and to the rear of said belt so as to cross at the rear.

* * * * *